US009706316B2

(12) United States Patent
Stiefenhofer

(10) Patent No.: US 9,706,316 B2
(45) Date of Patent: Jul. 11, 2017

(54) METHOD OF AUDITORY TRAINING AND A HEARING AID SYSTEM

(71) Applicant: Widex A/S, Lynge (DK)

(72) Inventor: Georg Stiefenhofer, Lynge (DK)

(73) Assignee: Widex A/S, Lynge (DK)

( * ) Notice: Subject to any disclaimer, the term of this patent is extended or adjusted under 35 U.S.C. 154(b) by 0 days.

(21) Appl. No.: 15/177,834

(22) Filed: Jun. 9, 2016

(65) Prior Publication Data

US 2016/0286322 A1 Sep. 29, 2016

Related U.S. Application Data

(63) Continuation-in-part of application No. PCT/EP2013/077611, filed on Dec. 20, 2013.

(51) Int. Cl.
*H04R 25/00* (2006.01)

(52) U.S. Cl.
CPC ..... *H04R 25/552* (2013.01); *H04R 25/505* (2013.01); *H04R 25/70* (2013.01); *H04S 2420/01* (2013.01)

(58) Field of Classification Search
CPC .... H04R 25/70; H04R 25/356; H04R 25/402; H04R 25/405; H04R 25/407; H04R 25/505; H04R 25/554; H04R 25/558; H04R 2225/41; H04S 2420/01
USPC ..... 381/312, 313, 314, 315, 317, 318, 320, 381/321
See application file for complete search history.

(56) References Cited

U.S. PATENT DOCUMENTS

2012/0093320 A1* 4/2012 Flaks ..... A63F 13/54 3/54
2013/0202119 A1* 8/2013 Thiede ..... A61B 5/0482 381/23.1
2015/0189940 A1* 7/2015 Teichert ..... A43B 3/16 36/72 R

FOREIGN PATENT DOCUMENTS

WO 2011/006681 A1 1/2011
WO 2012/103940 A1 8/2012

OTHER PUBLICATIONS

Robert W. Sweetow, PhD et al., "Warning: Do Not Add on Aural Rehabilitation of Auditory Training to Your Fitting Procedures", Hearing Review Jun. 2007, from the 2007 Clinical Research Summit.
International Search Report of PCT/EP2013/077611 dated Apr. 2, 2014.
Written Opinion of PCT/EP2013/077611 dated Apr. 2, 2014.

* cited by examiner

*Primary Examiner* — Brian Ensey
(74) *Attorney, Agent, or Firm* — Sughrue Mion, PLLC

(57) ABSTRACT

A binaural hearing aid system (100) is configured to execute a method of auditory training, wherein the hearing aid user is trained by trying to bring a randomly moving simulated acoustic source to a desired position. The invention further provides a method of auditory training.

9 Claims, 2 Drawing Sheets

METHOD OF AUDITORY TRAINING AND A HEARING AID SYSTEM

RELATED APPLICATIONS

The present application is a continuation-in-part of application PCT/EP 2013077611, filed on 20 Dec. 2013, in Europe, and published as WO 201509043 A1.

BACKGROUND OF THE INVENTION

1. Field of the Invention

The present invention relates to a method of auditory training. The invention also relates to a hearing aid system configured to carry out said method of auditory training. Furthermore the invention relates to a computer-readable storage medium having computer-executable instructions carrying out the method according to the invention when executed in a personal communication device.

Generally a hearing aid system according to the invention is understood as meaning any system which provides an output signal that can be perceived as an acoustic signal by a user or contributes to providing such an output signal and which has means which are used to compensate an individual hearing loss of the user or contribute to compensating the hearing loss of the user or contribute to compensating the hearing loss. A binaural hearing aid system according to the present invention always consists of two hearing aids, one for each ear of the hearing aid user. The binaural hearing aid system may also comprise a remote control.

Furthermore, auxiliary devices whose main aim is not to compensate for a hearing loss, for example consumer electronic devices (smart phones, tablet computers, personal digital assistants (PDAs), MP3 players, televisions, hi-fi systems etc.) may also be considered part of a hearing aid system, provided they have measures for compensating for an individual hearing loss or measures for controlling the operation of a hearing aid.

Within the present context a hearing aid can be understood as a small, battery-powered, microelectronic device designed to be worn behind or in the human ear by a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor configured to provide said amplification, and an acoustic output transducer. The signal processor is preferably a digital signal processor (DSP). The hearing aid is enclosed in a casing suitable for fitting behind or in a human ear.

Thus within the present context the term "hearing aid system device" may denote a hearing aid or an auxiliary device.

Auxiliary devices such as remote controls, or smart phones and tablet computers adapted for use with hearing aids are known. They offer a convenient way of operating various user-accessible features of a hearing aid such as volume level and program selection.

Hearing aid systems can compensate for compromised audibility and provide frequency dependent amplification. However, it may be difficult for the hearing aid system to fully compensate all the difficulties that hearing impaired users face, due to their limited frequency resolution, impaired temporal processing, maladaptive listening strategies and changes in cognitive function. Some of these abilities may be improved by training.

New users of hearing aids may experience several problems when getting accustomed to their new hearing aids because the sound is different as a consequence of e.g. the microphone system providing a change in sensitivity for sound emerging from some directions or as a consequence of the partly of fully occluded ear canal that a hearing aid earpiece causes. One particular problem, especially with behind-the-ear (BTE) devices, is the front/back confusion, where the user experiences difficulties in recognizing whether a sound is coming from the front or the back, due to the lack of sound shaping from the outer ear (i.e. the pinna of the ear), because the sound is picked up by microphones located behind the ear and transferred directly into the ear canal by placing the loudspeaker in the ear canal, or by a sound tube conducting the sound from the BTE part of the hearing aid and into the ear canal of the user.

Another problem is that new users of hearing aids will experience sound in frequency regions where they are not used to hear anything, because their hearing loss is so severe that they will rarely experience sounds loud enough to excite the cochlear. As most new hearing aid users have had their hearing loss for several years, they have grown accustomed to a much narrower sound environment, and thus they need to become acquainted with the enhanced sound environment anew. These and other problems may, to some degree, be overcome by training. However, when users experience these problems, they are often reluctant to use their hearing aids, especially in situations where they have experienced the problems, and consequently the user rarely gets enough training to overcome the problems and may simply give up.

The invention provides a way to motivate the user to train his or her perception, by providing a fun and motivating method of auditory training, wherein the hearing aids provide sounds that appear to originate from different directions, including directions known to be problematic for the user to recognize, whereby the user is motivated to train the localization of sounds coming from different directions as well as other issues known to be problematic especially for new hearing aid users.

To make the auditory training fun and motivating it should be adapted for the cognitive skills of the specific user.

2. The Prior Art

The problem of stigmatization when wearing hearing aids has been dealt with in different ways over the years. One proposed solution has been to make the hearing aid as small and inconspicuous as possible and preferably locating the hearing aid completely in the ear canal of the user, where it is practically invisible. However, this may in fact have increased the issue of stigmatization, because the hearing aid users are trying to hide the hearing aid and their hearing loss.

Another direction in the effort to overcome stigmatization has been to provide behind-the-ear type hearing aids in bright and shiny colors, and hearing aids with exchangeable covers, to allow the user to change the color of his or her hearing aid, to match the dress or tie worn.

Yet another proposed solution has been to shape the hearing aid like a headset used for e.g. cell phones, to make the hearing aid look more like an accessory.

Although these different approaches in many ways have made hearing aids smarter, many users, especially first time users, feel stigmatized because of their hearing loss. Consequently many hearing disabled refrain from using their hearing aids in situations with many people. This often leads to a problem with getting used to the "new sound" as it is perceived through the hearing aid.

The proposed hearing aid system is configured to provide a method of auditory training that allows the user to play an entertaining and motivating game, using his hearing aid system. This will potentially increase the usage time of the hearing aid system, because the user finds the game fun and cognitively challenging and therefore wants to spend time wearing his or her hearing aids in order to play the game, and advance in level and difficulty. Furthermore the use of hearing aids for playing such a game may take away the stigmatization, because people see the hearing aids as an entertaining and exciting thing instead of as a remedy for a handicap. It is furthermore foreseen that coming generations of hearing aid users, who grew up with computer games like PAC-MAN and similar games, will find this an attractive, entertaining and challenging feature.

Furthermore the game (i.e. the method of auditory training) may be created so as to train the user in benefitting from the audiological features built into the hearing aid system or to provide a relaxation program, e.g. people suffering from tinnitus might take advantage of such a program to relax and take focus away from their tinnitus.

Generally computer games need several interface devices like a screen, loudspeakers, keyboard, joystick etc. Hearing aids have, due to their size, a very limited user interface, because user interfaces are size demanding. Completely-in-canal hearing aids and small BTE hearing aids have no volume control and no program control, because there is no room for such buttons at the hearing aid. Consequently it is counter intuitive to use a hearing aid for playing and controlling a hearing aid.

Despite the documented benefit of training, several reports have shown that less than 10% of audiologists offer comprehensive auditory training to patients with hearing impairment. Reasons for the reluctance to offer training are described in the article: "WARNING: Do NOT Add On Aural Rehabilitation or Auditory Training to Your Fitting Procedures", by Sweetow and Henderson Sabes in Hearing Review June 2007, from the 2007 Clinical Research Summit.

It is therefore a feature of the present invention to provide a more efficient, motivating and entertaining method of providing auditory training and to provide a hearing aid system for training the auditory skills of a hearing impaired user.

SUMMARY OF THE INVENTION

The invention, in a first aspect, provides a binaural hearing aid system comprising a first hearing aid, a second hearing aid, and a first wireless link configured for establishing a wireless connection between the two hearing aids of the binaural hearing aid system, wherein each of the hearing aids comprises a primary signal path comprising an acoustical-electrical input transducer, a digital signal processor configured to amplify an electrical input signal, representing an acoustic input to the acoustical-electrical transducer, in order to alleviate a hearing loss of an individual hearing aid system user, hereby providing a processed electrical input signal, and an electrical-acoustical output transducer; a sound generator configured to provide an electrical training signal, representing the acoustic output from a virtual object; a Head-Related-Transfer-Function filter, configured to receive the electrical training signal as input and providing as output a filtered electrical training signal; a summing unit adapted for adding the processed electrical input signal to a signal in the primary signal path of the first hearing aid; a synchronization unit adapted for synchronizing the operation of the two hearing aids of the binaural hearing aid system at least with respect to the output from the sound generators and the setting of the Head-Related-Transfer-Function filters; wherein at least one of the hearing aids comprises a randomization unit adapted to provide an at least partly and in time varying, random position for said virtual object relative to the binaural hearing aid system, a user input adapted to provide a change of the random position for said predetermined virtual object by the user intending to move the position for said virtual object to a desired position, a position determination unit adapted to determine the position for said predetermined virtual object based on the input from the randomization unit and from the user input; and a look-up table holding Head-Related-Transfer-Functions for a number of discrete positions for said virtual object, whereby the Head-Related-Transfer-Function filters of the two hearing aids can be set such that a selected one of said discrete positions of the virtual object relative to the binaural hearing aid system is simulated for a user of the binaural hearing aid system.

The invention, in a second aspect, provides a method of auditory training comprising the steps of providing a binaural hearing aid system having a first hearing aid and a second hearing aid, providing, in each of the hearing aids of the binaural hearing aid system, an electrical training signal representing the acoustic output from a virtual object, synchronizing the training signals among the two hearing aids; applying a set of a left and a right Head-Related-Transfer-Function onto said synchronized electrical training signals, in the left and the right hearing aid, respectively, wherein said set of Head-Related-Transfer-Functions is adapted to simulate a virtual object at a given position relative to the binaural hearing aid system; automatically and, at least partly, randomly varying the position of the virtual object relative to the binaural hearing aid system, moving said position of the virtual object, in response to a binaural hearing aid system user input, with the aim of bringing the virtual object to a desired position relative to the binaural hearing aid system.

The invention in a third aspect provides a non-transitory computer-readable storage medium carrying computer-executable instructions, which when executed in a personal communication device provides auditory training of a hearing impaired person through interaction with a binaural hearing aid system adapted for use by said hearing impaired person, and by executing the steps of a method of auditory training comprising the steps of providing a binaural hearing aid system having a first hearing aid and a second hearing aid, providing, in each of the hearing aids of the binaural hearing aid system, an electrical training signal representing the acoustic output from a virtual object, synchronizing the training signals among the two hearing aids; applying a set of a left and a right Head-Related-Transfer-Function onto said synchronized electrical training signals, in the left and the right hearing aid, respectively, wherein said set of Head-Related-Transfer-Functions is adapted to simulate a virtual object at a given position relative to the binaural hearing aid system; automatically and, at least partly, randomly varying the position of the virtual object relative to the binaural hearing aid system, moving said position of the virtual object, in response to a binaural hearing aid system user input, with the aim of bringing the virtual object to a desired position relative to the binaural hearing aid system.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

Figure 1:
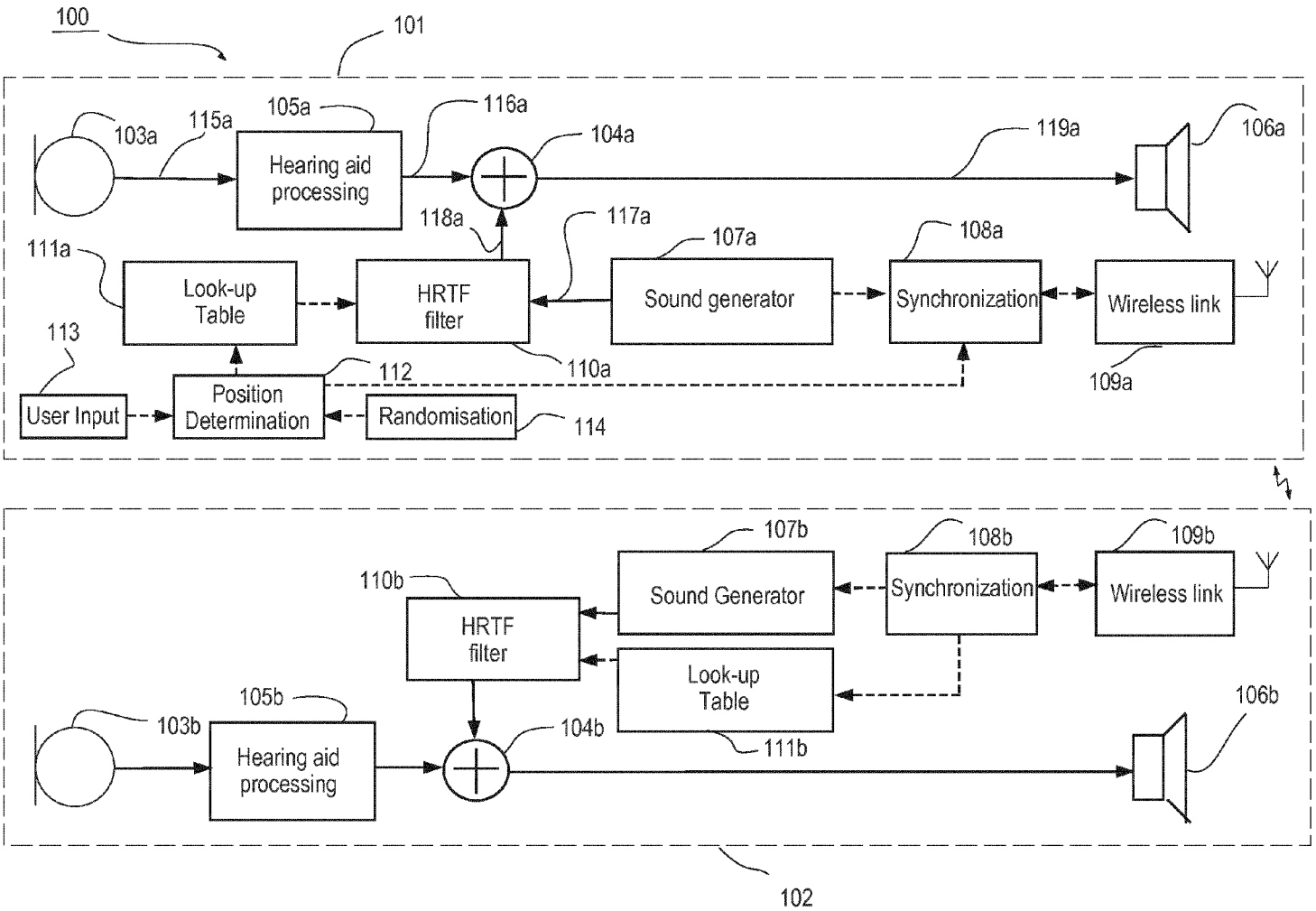
FIG. 1 illustrates highly schematically a binaural hearing aid system according to a first embodiment of the invention.

According to an embodiment of the invention a method of auditory training is provided wherein the hearing aid system user impersonates "Harry the frog". Harry is hungry and the aim for Harry is to catch a fly. As the hearing aids don't have a screen, the user (Harry) has to find and catch the fly using only his hearing sense and therefore Harry needs to navigate towards the fly purely based on acoustical cues. In a simple embodiment of the invention, the hearing aid system comprises a binaural set of hearing aids and an auxiliary device such as a hearing aid remote control or a smart phone communicating with the hearing aids. The user (Harry) now has to move in on the fly. This may be done by using a volume control on the remote control to turn left or right and hereby face towards the fly. When facing the fly, a third button, e.g. a program button, may be used for moving in the direction facing the fly. Harry will catch the fly simply by getting close enough to it or have a fourth button for snapping the tongue to catch the fly.

The method provides the user with the perception that the fly flies around the head of the user. The movement of the fly is simulated using Head-Related-transfer-Functions (HRTFs). A HRTF is a filter mechanism which gives the user a perception of the sound coming from a distinct location by manipulating the phase and amplitude of the sound, i.e. changing the interaural intensity difference (IID) and the interaural time difference (ITD) of the sound arriving at the eardrum of the right and left ear respectively. The HRTF may be implemented as a standard finite-impulse-response (FIR) filter.

A continuous movement of the fly from a point A towards point B can be acoustically simulated, by adaptively changing the chosen HRTF corresponding to point A towards an HRTF corresponding to point B. The continuous movement of the fly and hereby the sound appearing to originate from the fly may be realized by a time-varying filter such as a Finite Impulse Response (FIR) filter. Preferably the HRTFs for both ears and for a range of incident directions are stored in a look-up table in the hearing aid system. The position (i.e. the incident direction of the sound relative to the hearing aid system user) of the fly is controlled partly through manual input from the hearing aid system user and partly through an automated and at least partly random mechanism provided by the hearing aid system. The random mechanism may select between a predetermined number of discrete positions for the fly. When a position is selected for the fly, the corresponding set of HRTFs are found using the look-up table and are loaded into the hearing aids.

According to an embodiment the automated mechanism for moving the fly is adapted such that a new position (which may also be denoted an incident direction) is selected completely random. In variations the automated mechanism is adapted such that the new position is only selected randomly within a predetermined limited distance or angular offset from the current position.

According to an embodiment the manual input from the hearing aid system user provides that a neighboring position of the fly is selected based on a corresponding direction being selected by the user. According to a variation the automated mechanism and the manual user input are adapted such that the time interval between the selections of a new position, by the automated mechanism, is longer than the time required to elapse before a new neighboring position can be selected by the user.

According to a variation of the method of the invention, the predetermined number of discrete positions is of such a magnitude that it is not required to adaptively change the filter coefficients of the HRTF filters in order to provide the hearing aid system with the perception of a continuously moving fly. Thus the perception of continuous movement is provided simply by switching between the sets of HRTFs stored in the hearing aid system. According to a further variation the inventors have found that a set of HRTFs for each 5 degrees of difference in incident direction of the sound from the virtual source (the fly) is sufficient to provide the user with the perception of a continuously moving fly.

It is well known how to determine the HRTFs corresponding to a given position of the virtual source (and hereby the incident direction). To determine the sound pressure which any given signal produces in front of a person's eardrum it is sufficient to know the impulse response between the source and the eardrum. This is referred to as the HRIR (Head Related Impulse Response). Its Fourier-transformed function is the HRTF (Head Related Transfer Function). The HRTF comprises all physical characteristic values for determining the position of a signal source.

According to an embodiment the measurements are performed on an artificial head, e.g. KEMAR (Knowles Electronics Mannequin for Acoustical Research). However, in variations the measurements may also be performed on an individual person. A known overview of how HRTFs are determined can be found for example in Yang, Wonyoung, "Overview of the Head-Related Transfer Functions (HRTFs) ", ACS 498B Audio Engineering, The Pennsylvania State University, July 2001. The HRTF is basically a function of four variables: the three space coordinates and the frequency.

According to an embodiment the sound of the fly is provided by a sound generator located either in at least one of the hearing aids or in an auxiliary device. The sound generator provides a sound sample with a duration of say 10 seconds that is looped in order to provide a continuous sound of the fly. In a specific variation the sound generator does not generate internally the sound of the fly but instead simply replays a recorded sound sample with sound resembling the humming of a fly.

According to variations the sound generator may provide electrical signals representing the sound of basically any object other than a fly. A hearing aid remote control, a smart phone or any other auxiliary device may be used as control device for executing the method of auditory training according to the invention. The auxiliary device is used to move the fly and to snap the tongue of Harry to catch the fly. E.g. volume up may be used to turn right and volume down may be used to turn left. In variations the auxiliary device may have far more advanced options, like e.g. a touch screen, where it is possible to point directly to the direction of interest. In other variations of the auditory training it may be that it is sufficient to move the fly in front of the user and that snapping of the tongue therefore is not required.

According to variations of the embodiments that require an auxiliary device, the hearing aids by themselves may also be used as control devices for executing the method of auditory training according to the invention. According to one specific embodiment at least one of the hearing aids may comprise an accelerometer that detects movements in two or three dimensions. This is then used to control the movement of the fly by detecting a movement of the hearing aids when a user wearing the hearing aids turns his head in order to follow the sound of the fly.

According to yet other embodiments the movement of the fly is controlled by using sound recognition techniques, where at least one of the hearing aids recognizes spoken commands from the user, e.g. "right", "left", "forward", etc. This may be recognized using a standard hearing aid microphone. Alternatively, the spoken commands may be recorded using an in-the-ear microphone, as the signals from in-the-ear microphones are less prone to noise from the surroundings and are in general very good at picking up the users own voice. According to yet another alternative the user may use non-spoken commands, such as click of the tongue in order to control the movement of the fly.

However, executing the method of auditory training from an auxiliary device may have several advantages compared to executing the method directly from the hearing aids. An auxiliary device is typically larger and therefore better suited to accommodate the required power and signal processing. Considering the embodiments of the invention where the method of the auditory training is executed by the hearing aids, the selected HRTFs and the sound of the fly have to be synchronized in the two hearing aids for the user to perceive the sound from the desired direction.

In embodiments where the sound generator is accommodated in an auxiliary device and sound of the fly is hereby streamed from the auxiliary device, the sound will arrive at the hearing aids at the same time, and latency is therefore less critical. In a variation a sound generator is accommodated in each of the hearing aids but controlled from an auxiliary device whereby synchronization of the sound generators is simplified and latency less critical.

In embodiments where the position determination unit, the user input and the randomization unit are accommodated in an auxiliary device the required processing in the hearing aids is alleviated whereby cost and power consumption can be reduced.

An auxiliary device may further add a graphical user interface whereby the auditory training may be improved. The inventor has found that the use of a graphical user interface may help people against feeling nausea when carrying out the auditory training.

According to another embodiment of the invention a brain-computer-interface (BCI) is implemented in a hearing aid as the user interface. The hearing aid is supplied with electrodes for recording brain waves, such as electroencephalography (EEG) signals or electromyography (EMG) signals from the user. This is used to detect what the intention of the user is and hereby control the fly as part of the auditory training. According to variations the fly may be controlled either by detecting that the user is focusing on the right side using brain wave detection such as EEG, and in response hereto move the fly to the left, or by detecting a blink with the right eye using EMG and in response hereto move the fly to the left, and in a further variation the detection of a blink with both eyes may provide that the user (Harry) snaps the tongue in order to catch the fly. For further details about brain wave detection and analysis reference may be had to WO-A1-2011006681.

According to an embodiment of the auditory training, the user will catch the fly, simply by coming very close to the fly, such that no snapping is required. This is simpler for the user to control and requires less control interfaces. According to a variation of the method the sound level is low when the user is far away from the fly, and when the user approaches the fly, the level of the sound increases. The sound level may be adjusted according to the hearing impairment of the user, in order to ensure that the user can hear the fly. Additionally the ambient noise may be relied on to adjust the volume of the sound of the fly, to ensure that the user is able to hear the fly over the ambient noise.

According to yet another embodiment of the auditory training, the difficulty of the training is adapted based on how successful the user has been in catching the fly.

According to a variation a number of HRTF filters may be used to control the difficulty of the training. At easy levels there is only a limited number of possible directions the fly can be located whereby the fly becomes easier to approach. At higher levels, the number of possible directions increases and the user will have to zoom in on a smaller target, whereby the difficulty is increased. Also the difficulty of the training may be adjusted by having the fly move faster or slower.

According to another variation, the auditory training is configured such that at entry levels the requirements for the user to move in on the fly are less demanding, than at higher levels. At a first level, the user may be able to catch the fly by snapping the tongue when within 20 degrees of the fly, whereas the user will only catch the fly when snapping the tongue within e.g. 5 degrees at higher levels of the game. Thus at higher levels, the user need to be better at localizing the sound and controlling the movement of the fly.

The auditory training may be updated with new versions, levels etc. via an auxiliary device connected to the internet. The device may further be used for executing an extended version of the training comprising a graphical user interface. According to a variation the internet may be used for a "high score list", which enables the user to compare his performance with other users. The high score or other data related to the auditory training may be stored in a log, whereby the data can be transferred to e.g. a high score list maintained by an internet site. Additionally, this internet site may be used to handle other issues related to the hearing aid system, such as hearing aid fine tuning. Furthermore the internet site may be used to recognize specific problems that the user may experience as part of the training or specific situations where the user needs more training to improve the auditory capabilities. This may be done by transferring a log of the auditory training including details about where the user has been successful or unsuccessful. By providing enough data it may be possible to recognize a pattern and hereby to determine situations where the user needs more training to get more benefit from his or her hearing aids.

Reference is now made to FIG. 1, which illustrates highly schematically a binaural hearing aid system 100 according to a first embodiment of the invention. The hearing aid system 100 comprises a first hearing aid 101 and a second hearing aid 102. The first hearing aid 101 comprises an acoustical-electrical transducer 103*a*, a summing unit 104*a*, a hearing aid signal processor 105*a*, an electrical-acoustical transducer 106*a*, a sound generator 107*a*, a synchronization unit 108*a*, a wireless link unit 109*a*, a HRTF function filter 110*a*, a look-up table 111*a*, a position determination unit 112, a user input 113, and an automated randomization unit 114.

In the first hearing aid 101 the acoustical-electrical transducer 103*a* transforms an acoustic signal from the surroundings into a first electrical signal representing the acoustical signal 115*a*, which is provided to an input of the hearing aid processor 105*a* for standard hearing aid signal processing adapted for alleviating a hearing deficit of the hearing aid user. The hearing aid processor 105*a* provides a processed first electrical signal 116*a* to a first input of the summing unit 104*a*.

The sound generator 107*a* provides a second electrical signal representing the sound of the "fly" 117*a* to the HRTF filter 110*a* that transforms the second electrical signal 117*a* into a first filtered electrical signal 118*a*, which is provided to a second input of the summing unit 104*a*. The summing unit 104*a* provides a sum electrical signal 119*a* that is the sum of the first processed electrical signal 116*a* and the first filtered electrical signal 118*a*. The sum electrical signal 119*a* is provided to the electrical-acoustical transducer 106*a* for converting the sum electrical signal 119*a* into sound.

The synchronization unit 108*a* ensures that the sound generator 107*a* is synchronized in time with the contra-lateral sound generator 107*b* and that the position determination unit 112*a* and hereby the currently selected HRTF filter 110*a* is also synchronized with the selected HRTF filter 110*b* in the contra-lateral hearing aid 102. The synchronization is achieved by exchanging status data between the two hearing aids 101, 102 using the wireless link units 109*a* and 109*b*.

The randomization unit 114 and the user input 113 both provide a control input to the position determination unit 112. Based on these inputs the position determination unit 112 determines the current position of the "fly" and provides this position to the look-up table 111*a*, whereby, in response hereto, the HRTF filter 110*a* can be set with the filter coefficients corresponding to the determined current position of the fly.

The second hearing aid 102 functions similar to the first hearing aid 101 apart from the fact that the position determination unit 112, the user input 113, and the randomization unit 114 are not part of the second hearing aid 102 and that the sound generator 107*b* and the HRTF filter 110*b* are controlled from the first hearing aid using the synchronization units 108*a* and 108*b* and the wireless link units 109*a* and 109*b*.

According to a variation of the embodiment of FIG. 1, the two hearing aids of the binaural hearing aid system are substantially identical. Hereby the cost of the hearing aids may be significantly reduced due to lower manufacturing- and logistics expenses. This variation requires that the user input, the position determination units and the randomization units are mutually synchronized. According to a specific variation the user input, the randomization unit, the position determination unit and the sound generator are all accommodated in an auxiliary device of the hearing aid system, whereby the sound of the "fly" may be provided from the auxiliary device and directly to the HRTFs 110*a* and 110*b* in the two hearing aids 101 and 102, and whereby the selected position is likewise provided from the auxiliary device and directly to the look-up tables 111*a* and 111*b* in the two hearing aids 101 and 102.

According to another variation of the embodiment of FIG. 1 two or more of at least parts of the digital processing units 105*a*, 105*b*, 107*a*, 107*b*, 108*a*, 108*b*, 110*a*, 110*b*, 111*a*, 111*b*, 112, 113 and 114 may be integrated in a digital signal processor in each of the respective hearing aids 101 and 102.

According to another variation of the embodiment of FIG. 1 the summing unit 104*a* is positioned upstream of the hearing aid processor 105*a*. However, by positioning the summing unit 104*a* upstream of the hearing aid processor 105*a*, which includes frequency dependent digital amplification in order to compensate an individual hearing deficit of the hearing aid system user, the directional clues provided by the HRTF filters 110*a* and 110*b* may be distorted in case the hearing aid system user has a highly asymmetric hearing loss. According to yet another variation of the embodiment of FIG. 1 the summing unit 104*a* is positioned downstream of the hearing aid processor 105*a* and the hearing loss compensation for the individual hearing aid system user is incorporated in the HRTF filter whereby the issue of an asymmetric hearing loss is resolved.

According to yet other variations of the embodiment of FIG. 1 the look-up table 111*b* in the second hearing aid 102 may be omitted and instead all the coefficients for the HRTF filter in the second hearing aid 102 are transferred directly from the first hearing aid 101.

According to still another variation of the embodiment of FIG. 1 the binaural hearing aid system is adapted such that the acoustical-electrical transducers 103*a* and 103*b* may be muted when the method of auditory training is executed.

According to yet another variation of the embodiment of FIG. 1 the user input 113 is adapted to simply relay a control signal provided by the user from a user input accommodated in an auxiliary device of the hearing aid system.

According to a further variation of the embodiment of FIG. 1, a second virtual object is included as part of the method of auditory training. Hereby the complexity and fun of the auditory training may be improved by the first virtual object having to avoid coming too close to the "hunting" second virtual object.

Figure 2:
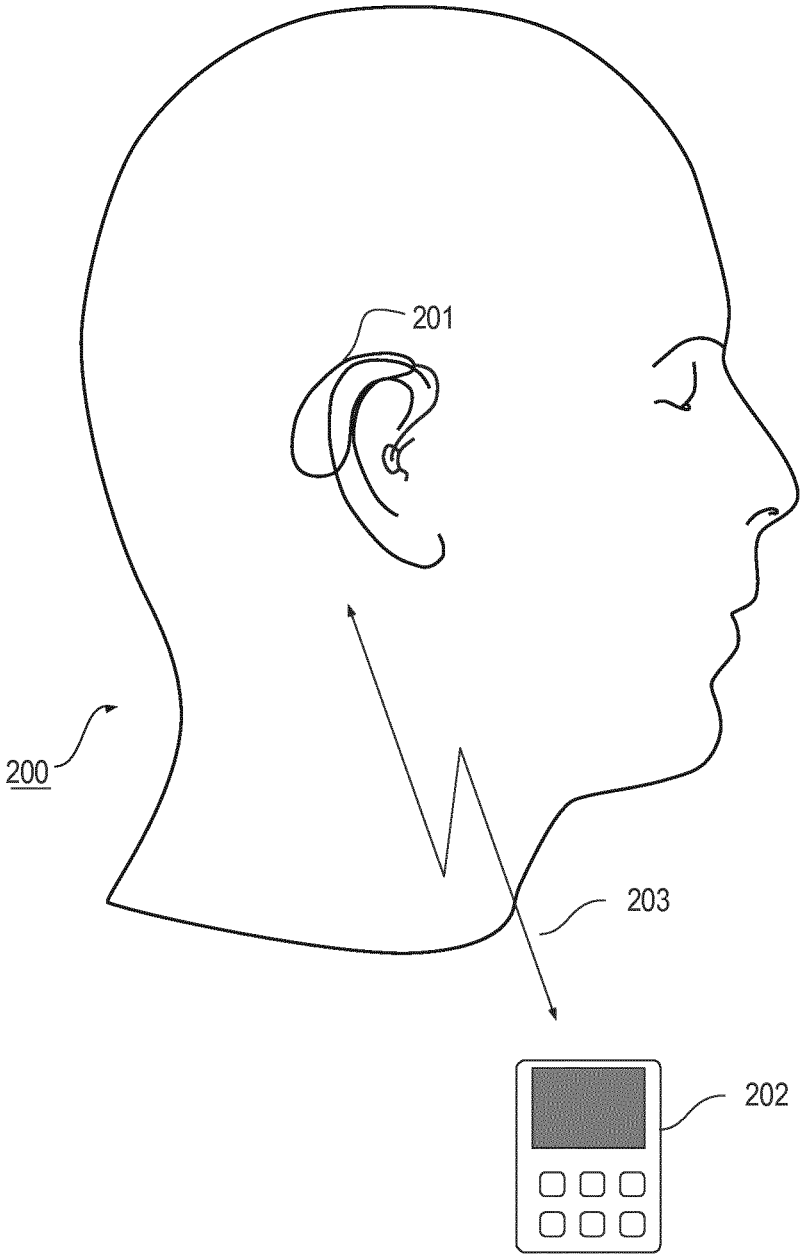
FIG. 2 illustrates highly schematically a binaural hearing aid system comprising an auxiliary device according to a second embodiment of the invention.

Reference is now made to FIG. 2, which illustrates a binaural hearing aid system 200 according to a second embodiment of the invention. The binaural hearing aid system comprises a first hearing aid 201, a second hearing aid (not shown) and an auxiliary device 203, wherein a wireless link 203 is configured for establishing a wireless connection between the two hearing aids of the binaural hearing aid system 200 and the auxiliary device 203.

According to a variation of the embodiment of FIG. 2, the method of auditory training is implemented as a computer software program (a so called "app") that may be downloaded by a smart phone or a tablet computer.

Generally the variations, mentioned in connection with a specific embodiment, may, where applicable, be considered variations for the other disclosed embodiments as well.

Thus e.g. the specific methods of controlling the movement of the fly do not depend on a specific embodiment and neither do the different methods for ensuring the synchronization of the HRTF filters in the hearing aids and the electrical signals representing nor do the different methods for providing and synchronizing the electrical signals representing the acoustic sound from the virtual object depend on a specific embodiment.

I claim:

1. A binaural hearing aid system comprising a first hearing aid, a second hearing aid, and a first wireless link configured for establishing a wireless connection between the two hearing aids of the binaural hearing aid system, wherein each of the hearing aids comprises:

a primary signal path comprising an acoustical-electrical input transducer, a digital signal processor configured to amplify an electrical input signal, representing an acoustic input to the acoustical-electrical transducer, in order to alleviate a hearing loss of an individual hearing aid system user, hereby providing a processed electrical input signal, and an electrical-acoustical output transducer;

a sound generator configured to provide an electrical training signal, representing the acoustic output from a virtual object;

a Head-Related-Transfer-Function filter, configured to receive the electrical training signal as input and providing as output a filtered electrical training signal;

a summing unit adapted for adding the processed electrical input signal to a signal in the primary signal path of the first hearing aid;

a synchronization unit adapted for synchronizing the operation of the two hearing aids of the binaural hearing aid system at least with respect to the output from the sound generators and the setting of the Head-Related-Transfer-Function filters;

wherein at least one of the hearing aids comprises:

a randomization unit adapted to provide an at least partly and in time varying, random position for said virtual object relative to the binaural hearing aid system, a user input adapted to provide a change of the random position for said predetermined virtual object by the user intending to move the position for said virtual object to a desired position, a position determination unit adapted to determine the position for said predetermined virtual object based on the input from the randomization unit and from the user input; and a look-up table holding Head-Related-Transfer-Functions for a number of discrete positions for said virtual object, whereby the Head-Related-Transfer-Function filters of the two hearing aids can be set such that a selected one of said discrete positions of the virtual object relative to the binaural hearing aid system is simulated for a user of the binaural hearing aid system.

2. The binaural hearing aid system according to claim 1, wherein the sound generator is adapted to provide the electrical training signal by replaying, in a loop, a training signal sample with a duration in the range between two seconds and one minute.

3. The binaural hearing aid system according to claim 1 comprising:

an auxiliary device accommodating the sound generator, the user input, the randomization unit and the position determination unit; and a second wireless link configured for establishing a wireless connection between the two hearing aids of the binaural hearing aid system and the auxiliary device.

4. The binaural hearing aid system according to claim 1, wherein each of the two hearing aids comprises a look-up table holding, for a number of discrete positions relative to the binaural hearing aid system, the filter coefficients required to set the HRTF filter of the ipse-lateral hearing aid such that the HRTF filter of the ipse-lateral hearing aid in combination with the HRTF filter of the contra-lateral hearing aid may be used to simulate, for a user of the binaural hearing aid system, a virtual object at the selected position relative to the binaural hearing aid system.

5. The binaural hearing aid system according to claim 4, wherein the look-up table holds, for a number discrete positions relative to the binaural hearing aid system, the filter coefficients required to set the HRTF filter of the ipse-lateral hearing aid and the HRTF filter of the contra-lateral hearing aid such that the binaural hearing aid system may be used to simulate, for a user of the binaural hearing aid system, the selected position of the virtual object relative to the binaural hearing aid system.

6. The binaural hearing aid system according to claim 5, wherein said look-up table is accommodated in an auxiliary device of the binaural hearing aid system.

7. The binaural hearing aid system according to claim 1 wherein the user input is configured to provide a relative change of the position for said virtual object.

8. A method of auditory training comprising the steps of:

providing a binaural hearing aid system having a first hearing aid and a second hearing aid, providing, in each of the hearing aids of the binaural hearing aid system, an electrical training signal representing the acoustic output from a virtual object, synchronizing the training signals among the two hearing aids;

applying a set of a left and a right Head-Related-Transfer-Function onto said synchronized electrical training signals, in the left and the right hearing aid, respectively, wherein said set of Head-Related-Transfer-Functions is adapted to simulate a virtual object at a given position relative to the binaural hearing aid system;

automatically and, at least partly, randomly varying the position of the virtual object relative to the binaural hearing aid system, moving said position of the virtual object, in response to a binaural hearing aid system user input, with the aim of bringing the virtual object to a desired position relative to the binaural hearing aid system.

9. A non-transitory computer-readable storage medium carrying computer-executable instructions, which when executed in a personal communication device provides auditory training of a hearing impaired person through interaction with a binaural hearing aid system adapted for use by said hearing impaired person, and by executing the steps of a method of auditory training comprising the steps of:

providing a binaural hearing aid system having a first hearing aid and a second hearing aid, providing, in each of the hearing aids of the binaural hearing aid system, an electrical training signal representing the acoustic output from a virtual object, synchronizing the training signals among the two hearing aids;

applying a set of a left and a right Head-Related-Transfer-Function onto said synchronized electrical training signals, in the left and the right hearing aid, respectively, wherein said set of Head-Related-Transfer- Functions is adapted to simulate a virtual object at a given position relative to the binaural hearing aid system;

automatically and, at least partly, randomly varying the position of the virtual object relative to the binaural hearing aid system, moving said position of the virtual object, in response to a binaural hearing aid system user input, with the aim of bringing the virtual object to a desired position relative to the binaural hearing aid system.

* * * * *